US012453428B2

(12) United States Patent
Li

(10) Patent No.: US 12,453,428 B2
(45) Date of Patent: Oct. 28, 2025

(54) BREATHABLE AND COMFORTABLE INFLATABLE MATTRESS

(71) Applicant: WangLi Plastic & Electronics (Huizhou) Co., Ltd., Guangdong (CN)

(72) Inventor: Yonghe Li, Guangdong (CN)

(73) Assignee: WANGLI PLASTIC & ELECTRONICS (HUIZHOU) CO., LTD., Guangdong (CN)

( * ) Notice: Subject to any disclaimer, the term of this patent is extended or adjusted under 35 U.S.C. 154(b) by 399 days.

(21) Appl. No.: 18/087,155

(22) Filed: Dec. 22, 2022

(65) Prior Publication Data

US 2024/0016304 A1 Jan. 18, 2024

(30) Foreign Application Priority Data

Jul. 15, 2022 (CN) ..... 202221833306.1
Jul. 15, 2022 (CN) ..... 202221836603.1
Jul. 15, 2022 (CN) ..... 202221836720.8
Sep. 16, 2022 (CN) ..... 202222465813.0

(51) Int. Cl.
*A47C 27/08* (2006.01)
*A47C 21/04* (2006.01)
*A47C 27/00* (2006.01)

(52) U.S. Cl.
CPC ..... *A47C 27/087* (2013.01); *A47C 21/048* (2013.01); *A47C 27/007* (2013.01); *A47C 27/082* (2013.01)

(58) Field of Classification Search
CPC ..... A47C 27/006; A47C 27/007; A47C 27/08; A47C 27/081; A47C 27/082; A47C 27/083; A47C 27/084; A47C 27/085; A47C 27/086; A47C 27/087; A47C 27/088; A47C 27/10; A47C 21/04; A47C 21/042; A47C 21/044; A47C 21/046; A47C 21/048
See application file for complete search history.

(56) References Cited

U.S. PATENT DOCUMENTS 3,772,717 A * 11/1973 Yuen ..... A47C 27/10 5/422
3,879,776 A * 4/1975 Solen ..... A47C 27/081 297/DIG. 2
6,017,601 A * 1/2000 Amsel ..... B32B 5/26 428/36.1
6,413,458 B1 * 7/2002 Pearce ..... A47C 27/15 264/141

(Continued)

*Primary Examiner* — George Sun
(74) *Attorney, Agent, or Firm* — Muncy, Geissler, Olds & Lowe, P.C.

(57) ABSTRACT

A breathable and comfortable inflatable mattress includes a top layer, a surrounding band and a bottom layer, which together define a cavity of the inflatable mattress. The top layer includes a breathable layer and a ticking layer, the ticking layer and the surrounding band are connected by welding or bonding. The breathable layer is arranged on the ticking layer, and the breathable layer is connected to the surrounding band via a sealing layer. The inflatable mattress according to the present invention is replaced the traditional flock/PVC or PVC material with comfortable fabric for the top layer, which can greatly improve comfort and breathability, avoid noise generated by friction between the user's body and PVC, and improve user' s sleep quality, thus meeting needs of users widely.

18 Claims, 17 Drawing Sheets

(56) References Cited

U.S. PATENT DOCUMENTS

| | | | | |
|---|---|---|---|---|
| 2006/0053558 | A1* | 3/2006 | Ye | A47C 27/18 5/689 |
| 2007/0135878 | A1* | 6/2007 | Lachenbruch | A47C 27/002 607/108 |
| 2008/0000030 | A1* | 1/2008 | Wang | A47C 27/087 5/713 |
| 2009/0044338 | A1* | 2/2009 | Rock | D04B 1/04 5/500 |
| 2010/0071130 | A1* | 3/2010 | Frias | A47C 27/082 5/710 |
| 2014/0041127 | A1* | 2/2014 | Codos | A47C 27/10 5/713 |
| 2014/0259418 | A1* | 9/2014 | Nunn | A47C 21/003 5/713 |
| 2018/0000255 | A1* | 1/2018 | Youngblood | F28F 3/12 |
| 2020/0315365 | A1* | 10/2020 | Kondo | B32B 5/262 |
| 2020/0323355 | A1* | 10/2020 | Jacot | A47C 27/088 |
| 2021/0169232 | A1* | 6/2021 | Hou | A47C 27/087 |
| 2021/0204720 | A1* | 7/2021 | Karschnik | A47C 31/007 |
| 2021/0259434 | A1* | 8/2021 | Wang | A47C 27/10 |
| 2023/0034818 | A1* | 2/2023 | Zerhusen | A47C 21/048 |

* cited by examiner

BREATHABLE AND COMFORTABLE INFLATABLE MATTRESS

CROSS REFERENCE TO RELATED APPLICATIONS

The present application claims priorities from Chinese Patent Application No. 202221833306.1 filed on Jul. 15, 2022, 202221836603.1 filed on Jul. 15, 2022, 202221836720. 8 filed on Jul. 15, 2022, and 202222465813.0 filed on Sep. 16, 2022, all of which are hereby incorporated herein by reference.

TECHNICAL FIELD

The present invention relates to the field of inflatable products, and more particularly, relates to a breathable and comfortable inflatable mattress.

BACKGROUND

An inflatable mattress is a mattress with strong flexibility and elasticity, which is expanded to a larger volume after inflation. With the inflatable mattress, users can be in close fit with the bed, so that the cervical spine, lumbar spine, legs and wrists of the user are no longer suspended, which thus can eliminate fatigue feeling of human bodies as soon as possible. In addition, the inflatable mattress is also very portable and can be folded up to a size as a pillow, so it can be folded up and placed in a locker when is out of use, and can be taken out and filled with air when is in use. With the advantage of portability and less area occupancy, the inflatable mattress can be placed indoors and outdoors at will, overcoming the defects that the traditional furniture exists, such as its bulkiness and larger area occupancy. People thus can use it when working outside, moving frequently, camping in the field, swimming, escorting or taking a temporary break from work. However, with its wide range of applications, demand for inflatable mattresses is increasingly growing.

A top layer of the inflatable mattresses currently on the market is generally made of flock/PVC or PVC alone, the material in direct contact with the human body thus fails in good breathable effect, which greatly reduces comfort. Due to the poor breathability of the inflatable mattress, user's skin in contact with the mattress is more prone to itching, erythema and other symptoms, the bedding on it will have moisture, users are thus prone to rheumatism after long-term use, which further reduces adaptability of the inflatable mattress and cannot satisfy people's needs. Therefore, there is a need to provide an inflatable mattress with improved comfort and breathability.

SUMMARY

Accordingly, the present invention provides an inflatable mattress which has improved breathability and comfort.

According to the present invention, a breathable and comfortable inflatable mattress is provided, which includes a top layer, a surrounding band and a bottom layer. A cavity of the inflatable mattress is defined by the top layer, the surrounding band and the bottom layer. The top layer includes a breathable layer and a ticking layer. The ticking layer and the surrounding band are joined by welding or bonding. The breathable layer is arranged on the ticking layer, and periphery of the breathable layer is joined with the surrounding band by a sealing layer.

The top layer is configured to support the human body and is connected to the bottom layer via the surrounding band to form a mattress body. The breathable layer in the present invention is made of a comfortable and breathable fabric to improve comfort in use. The ticking layer is used for better connection with an upper encircling piece to enhance air tightness, and together with the breathable layer, also used for supporting the human body. In addition, the connection of the surrounding band and the ticking layer forms a shaping effect for the whole inflatable mattress. Optionally, the fabric of the surrounding band can be formed by bonding flock/PVC, PVC, TPU or formed by one of them bonding with a fabric. The material of the bottom layer can also be formed by bonding flock/PVC, PVC, TPU or formed by one of them bonding with a fabric, and the material of the ticking layer can be cloth/PVC, PVC or a mesh sandwiched material.

The breathable layer is in direct contact with the human body according to the present invention, as a result, comfort and breathability of the inflatable mattress in the present invention is greatly improved by replacing the traditional flock/PVC or PVC material with a comfortable material, thus providing the user more comfortable feeling in use. In addition, the breathable layer is connected to the surrounding band via a sealing layer, such configuration can be easy to open the breathable layer to clean or replace the elements inside. The sealing layer can be a zipper or a slidable sealing part.

Besides, a mattress body of the existing inflatable mattresses will bulge and expand after inflation to protrude like a bread, which results in neither aesthetically pleasing nor flat, and affecting service life thereof. However, according to the present invention, a hollow structure will be formed between the breathable layer and the ticking layer, which can limit the expansion of the top layer, making the overall stretching of the mattress body smoother and thus making the mattress body more aesthetically pleasing and more comfortable. Such configuration can also prevent the mattress body from being broken, thus prolonging service life thereof.

Still further, a conventional inflatable mattress is usually provided with an encircling piece on the top layer to form a bulged air chamber directly surround the top layer without any space, which will seriously affect attractiveness and comfortability. According to the present invention, the breathable layer and the surrounding band are directly connected, such configuration thus makes the inflatable mattress more attractive, and the area of the top layer available for sleeping is also increased, thus improving comfortability.

According to at least one embodiment of the present invention, the top layer can further include a soft cushion layer between the breathable layer and the ticking layer.

The configuration of the soft cushion layer in the present invention can improve softness of the top layer of the inflatable mattress, thereby improving comfort and practicability, which thus improves the user's sleep quality. The soft cushion layer may be a liquid cushion, an ice cushion, or a soft cushion containing other liquids.

Preferably, the soft cushion layer is a liquid cushion, and the liquid cushion is provided with a liquid passing port.

Liquid cushion has advantages of suffering force evenly, improved comfort of the mattress due to fluidity of the liquid, which can also balance user's body weight and improve user's blood circulation. When on use, liquid can be injected into the liquid cushion through the liquid passing port, and when out of use, liquid can be discharged from the liquid passing port, making the inflatable mattress conveniently stored.

In addition, according to the present invention, the inflatable mattress can be warm in winter and cool in summer by adjusting temperature of the liquid. The mattress thus can satisfy different demands of users on the temperature and optimize user's experience.

A plurality of detachable connecting and fixing structures can be provided below the soft cushion layer, which is configured to fix the soft cushion layer to the ticking layer to prevent displacement thereof. Optionally, the connecting and fixing structure can be a snap, a hook and loop fastener, or a button, etc.

According to at least one embodiment of the present invention, the soft cushion layer can be connected to an intelligent cooling/heating system via a liquid inlet pipeline and a liquid outlet pipeline to regulate temperature of the liquid in the soft cushion layer.

Such system in the present invention has a housing. A control panel is arranged at the upper end of the top of the housing. An L-shaped partition plate is arranged at the bottom end of the housing, which divides the housing into a first chamber and a second chamber. The first chamber can be a liquid box, both sides of the liquid box are respectively provided with a cooling end exchanger extending into the liquid box, the two cooling end exchangers are respectively provided with a cooling element, and each cooling element is attached to a heat sink. One side of the first chamber is provided with an open hole, so that the liquid outlet pipeline extends into the liquid box through the open hole. A circulating liquid pump is provided in the second chamber, which is connected to an external power supply through a wire. An input end of the circulating liquid pump is fixedly connected to a liquid pumping pipe, and an output end thereof is connected to a liquid passing pipeline communicating with the liquid inlet pipeline. A heater is disposed on the liquid passing pipeline, and one side of the housing close to the second chamber is provided with heat dissipation holes.

In such configuration, when the inflatable mattress is required to be heated, the heater can be turned on via the control panel, liquid in the liquid cushion will enter the liquid box via the liquid outlet pipeline, the circulating liquid pump is started, the liquid in the liquid box will be pumped out to the liquid passing pipeline via the liquid pumping pipe, the liquid will be heated by the heater and then enter the liquid cushion via the liquid inlet pipeline, the temperature of the inflatable mattress thus will rise. When the inflatable mattress is required to be cooled, the cooling element will be turned on by the control panel and the heater will be turned off, the two cooling elements will absorb heat from the liquid in the liquid box through the cooling end exchangers, thereby achieving cooling of the liquid in the liquid box.

One side of the soft cushion layer is further provided with a liquid inlet and a liquid outlet according to the present invention. The liquid inlet is connected to the liquid inlet pipeline, and the liquid outlet is connected to the liquid outlet pipeline. Correspondingly, the surrounding band is provided with two through holes corresponding to the liquid inlet and liquid outlet, and the liquid inlet pipeline and the liquid outlet pipeline are respectively passed through the two through holes.

In such configuration, the liquid inlet pipeline is passed through the liquid inlet and the through hole in the surrounding band to connect the soft cushion layer and the intelligent cooling/heating system, and the liquid outlet pipeline is passed through the liquid outlet and the through hole in the surrounding band to connect the soft cushion layer and the intelligent cooling/heating system.

According to at least one embodiment of the present invention, spacers can be provided in the soft cushion layer, which forms a liquid loop channel in S-shaped curve.

The spacer can be connected to the top surface and the bottom surface of the liquid cushion by welding or in fit connection. The liquid loop channel in S-shaped curve is formed in the soft cushion layer through the spacers, so that the liquid can be heated more evenly, further optimizing user's experience of using the inflatable mattress by regulating temperature. Optionally, the liquid loop channel can be horizontal or vertical, and material of the spacer can be PVC or TPU.

The width of the liquid loop channel can be 4-20 cm according to the present invention, and corners of the liquid loop channel are in rounded corners.

It should be noted that too large width of the liquid loop channel will affect heating uniformity of the liquid, while too small width of the liquid loop channel will affect flow rate of the liquid. Therefore, appropriate channel width is conducive to uniform heating of the liquid with liquid flow normally passing. The rounded corner of the liquid loop channel will further reduce obstruction of the liquid flow to make the liquid flow more smoothly.

According to at least one embodiment of the present invention, the sealing layer is a zipper, and the zipper is connected to the breathable layer and the surrounding band. The upper side of the surrounding band and both sides of the zipper are each provided with a bending structure, so that the zipper is respectively connected to the surrounding band and the breathable layer via the bending structure. Preferably, the bending structure and the breathable layer are connected in a sewing manner. The bending structure makes the sewing connection stronger.

The bending length of the bending structure can be 0.3-2.54 cm, and the bending structure includes at least one bending layer.

It should be noted that too large or too small bending length of the bending position will be not conducive to actual production and use, while defining an appropriate length can save materials and production costs on the premise of ensuring the fixing degree of sewing, which conforms to practical production demands. The number of bending layers can be adjusted according to actual requirements.

According to the present invention, material of the breathable layer can be a single-layer cloth, a multi-layer cloth or a pleated cotton cloth.

Compared with traditional flock/PVC or PVC material, the material, such as single-layer cloth, multi-layer cloth or pleated cotton cloth, has higher comfort and better softness, while also reducing noise generated by the friction between the PVC material and the user, which can better meet the needs of users widely.

According to at least one embodiment of the present invention, an upper encircling piece and a lower encircling piece are further provided. An upper edge air chamber is defined by the upper encircling piece, the top layer, especially the ticking layer of the top layer, and the surrounding band. And a lower edge air chamber is defined by the lower encircling piece, the bottom layer, and the surrounding band.

Since no transverse drawing bands are provided in the mattress body, the periphery of the mattress body will bulge after inflation. While the upper encircling piece and the lower encircling piece can limit the shape of the surrounding band, which forms a bulging limit, thereby avoiding the collapse of the mattress body and also making the mattress body more attractive.

In addition, the upper encircling piece and the lower encircling piece communicate with the interior of the mattress cavity through a plurality of air inlets. The upper edge air chamber and the lower edge air chamber keep are intercommunicated, which forms support hardness and deformation resistance effects, and has good shaping capacity for the inflatable mattress, resulting in stable support effect when the inflatable mattress is used, thus making the inflatable mattress easy to storage and portable. The lower edge air chamber increases friction between the mattress body and the ground, so that grip of the mattress body to the ground is greater, forming more stable gripping, which achieves great anti-slip effect and thus improves comfort.

According to at least one embodiment of the present invention, a plurality of drawing bands are provided in the cavity, each drawing band is connected to the top layer and the bottom layer. The drawing band can be sheet-shaped or columnar, and the drawing bands are uniformly distributed in the cavity.

The drawing band has a shaping effect on the inflatable mattress body. Since the inflatable mattress is in a relatively high-pressure state after inflation, the top layer will expand and bulge. The drawing band will make the inflatable mattress form a certain fixed shape in an inflated state, making the surface of a bed body flat and attractiveness higher as a whole, also avoiding the rupture caused by expanding and bulging in many times, ensuring normal use of the inflatable mattress and prolonging service life thereof.

For columnar drawing band, the upper and lower bottom surfaces thereof are respectively connected to the top layer and the bottom layer. For the sheet-shaped drawing band, a bend portion at the connected position of the top layer and the bottom layer is formed. Each sheet-shaped drawing band is connected to the top layer and the bottom layer via the bending portion. The drawing band may be either vertical or inclined with respect to the bottom layer. In a preferred embodiment according to the present invention, the drawing band is gradually inclined outward from the top layer to the bottom layer of the inflatable bed from the middle to both sides, i.e., the angle formed by the drawing band disposed closer to the middle of the mattress body with the bottom layer more tends to be a right angle. With the drawing band obliquely provided, so that force bearing points of the top layer and the bottom layer of the drawing band at the same bed position are different, so that the force suffered by the top layer and the bottom layer will be more balanced, the bottom surface of the inflatable bed thus is more stable in grip on the ground, ensuring the stability and flatness of the inflatable bed.

According to at least one embodiment of the present invention, a seal layer is provided, which is connected to the surrounding band. An accommodating cavity formed by the seal layer, the surrounding band and the ticking layer is used for being filled with liquid. An opening is further formed in a side edge of the surrounding band. The user can change the liquid in the accommodating cavity through the opening.

A plurality of columnar drawing bands can be provided in the accommodating cavity according to the present invention. Each columnar drawing band is connected to the top layer and the bottom layer, and the ticking layer is provided with openings corresponding to the columnar drawing bands. The cavity and the columnar drawing band form a communicating space, which space is used for being filled with liquid.

Generally, the inflatable mattress can meet the requirements of use when inflated by about 80%. However, it is very difficult to grasp degrees of inflation in the process of inflation, the inflatable bed will be easy to overfill with too great air pressure in the cavity, and the extrusion force on the drawing band increases accordingly. It should be noted that forces acted on the drawing band and the ticking layer for a long time will cause a joint between the drawing band and the ticking layer to tear. While the drawing band filled with liquid will have a relative force acting on the extrusion force in the cavity, which reduces deformation degrees of the drawing band, thereby weakening tearing action on the drawing band and the ticking layer, thus prolonging service life thereof.

Besides, the inflatable mattress tends to be collapsed over time, especially in low temperature environments. The drawing band is filled with the liquid to form a liquid column, making the drawing band can not only limit excessive expansion of the inflatable bed surface, but also provide supporting on the ticking layer, so that there is no need to supplement air for the inflatable bed for a long using period.

According to at least one embodiment of the present invention, a heat conductive net is provided closely attached to the inner side of the drawing band and/or the upper side of the ticking layer, such as a metal wire mesh The opening at the lower end of the drawing band communicates with the outside, a heat conductive sheet connected to the heat conductive net is disposed in the drawing bands, such as a meta sheet, and the heat conductive sheet matches the cross section of the cavity in the drawing band.

The heat conductive net is configured to match the folding and unfolding of the inflatable mattress. The heat conductive net has effect of shaping and supporting on inflatable mattress, further avoiding the problem of frequent air supplement when in use. In addition, metal wires of the heat conductive net help to conduct heat from the liquid to the outside, and when the heat conductive sheet is in contact with the ground, the heat can be transferred to the ground quickly, the temperature of the liquid is thus lowered, achieving a cooling effect. Preferably, material of the heat conductive net and the heat conductive sheet is a carbon fiber composite material.

A heating disc can be provided below the heat conductive according to the present invention, and the heating disc matches the cross section of the cavity in the drawing band.

The heating disc can heat the metal sheet, the metal sheet in turn heats the liquid in the drawing band and the accommodating cavity. The metal wire mesh can accelerate heating of the liquid in the drawing band, due to thermal conductivity thereof, thus improving heating efficiency.

According to at least one embodiment of the present invention, the ticking layer is connected to the surrounding band, a massage layer is provided between the breathable layer and the ticking layer, and the breathable layer and the surrounding band are detachably connected. A massage device is provided on the massage layer, which includes at least one massager connected to the massage layer. A control assembly is disposed on the mattress body electrically connected to the massage device.

The massage device can further improve comfort of the inflatable mattress. Preferably, the massager can generate vibration or rolling. The control assembly can control the massage device to be started or closed. Preferably, the massager can be an eccentric motor assembly or a roller assembly.

The control assembly can be electrically connected to the massage device by an electric wire which is arranged on the massage layer. The control assembly may include a single controller and/or a dual controller.

Optionally, the single controller is electrically connected to the massage device. The dual controller may include a left controller electrically connected to a left massage device and a right controller electrically connected to a right massage device. The massage layer is connected to the breathable layer, and the massage device is arranged on the massage layer.

The massage device can be divided into a plurality of zones, and the control assembly has a plurality of controllers corresponding to the zones.

Optionally, the zones correspond to different parts of the user, such as the shoulders, the waist, the buttocks, the shanks, etc. Each massage device in different zones is connected to the respect controller, so that massage of a corresponding part of the user by the massage device can be started or stopped by the respect controller.

The massage layer can be connected to the breathable layer, and the massage device can be arranged on the massage layer.

The massage layer can also be connected to the soft cushion layer, and the massage device can be arranged on the massage layer.

DETAILED DESCRIPTION

Figure 1:
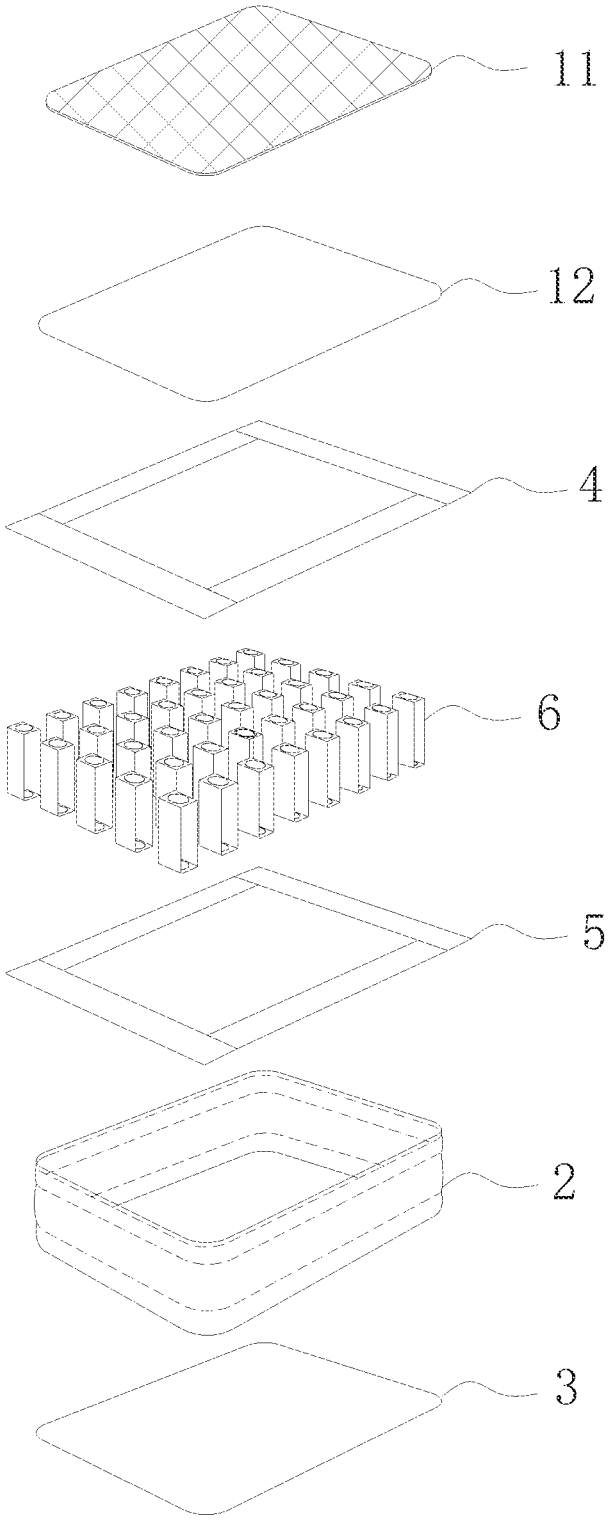
FIG. 1 is an exploded view of an inflatable mattress according to one embodiment of the present invention.

The accompanying drawings of the present invention are for exemplary illustration only, and should not be construed as limitations on the present invention. In order to better illustrate the following embodiments, some parts in the accompanying drawings may be omitted, enlarged or reduced, and they do not represent the size of the actual product. For those skilled in the art, it is understandable that certain well-known structures in the drawings and descriptions thereof may be omitted.

Figure 2:
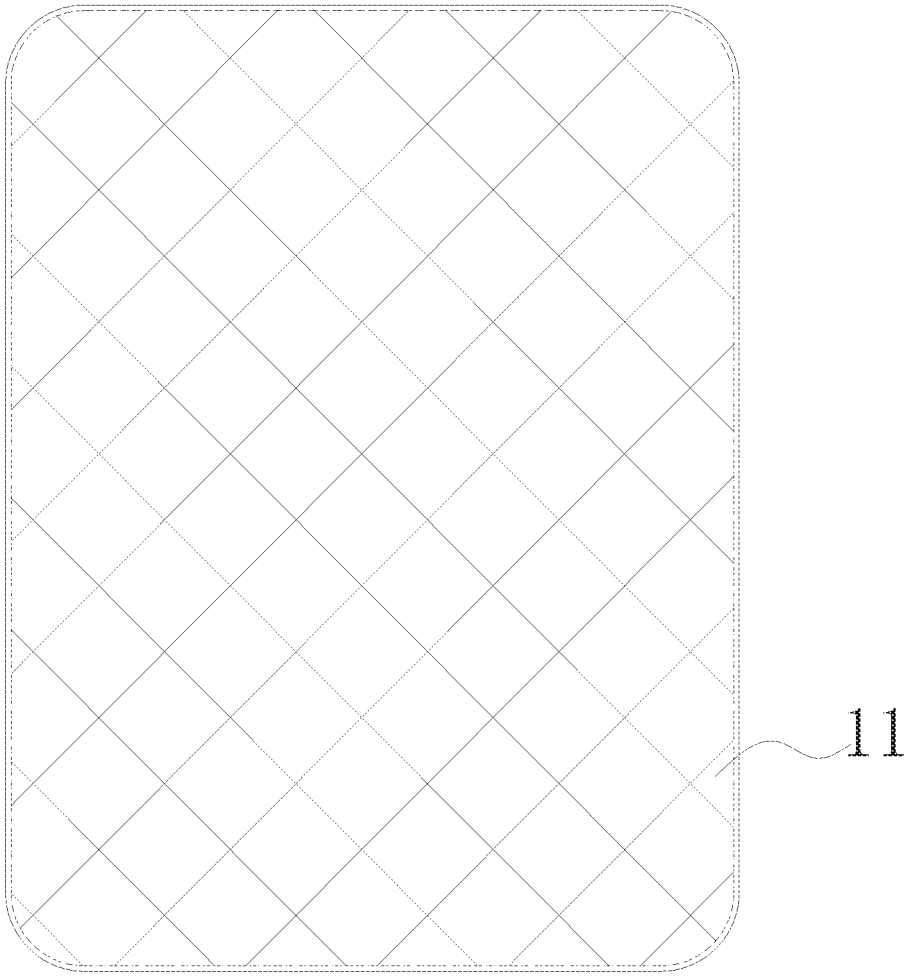
FIG. 2 is a top view of a top layer shown in FIG. 1.

Referring to FIG. 1 and FIG. 2, a breathable and comfortable inflatable mattress is provided, which includes a top layer 1, a surrounding band 2 and a bottom layer 3. A cavity 7 of the inflatable mattress is defined by the top layer 1, the surrounding band 2 and the bottom layer 3. According to the present embodiment, the top layer 1 has a breathable layer 11 and a ticking layer 12. The material of the breathable layer 11 is preferably a pleated cotton cloth. The ticking layer 12 and the surrounding band 2 are joined by welding or bonding. The breathable layer 11 is arranged on the ticking layer 12, and periphery of the breathable layer 11 is joined with the surrounding band 2 by a sealing layer 13. Preferably, the material of the ticking layer is cloth/PVC.

Figure 3:
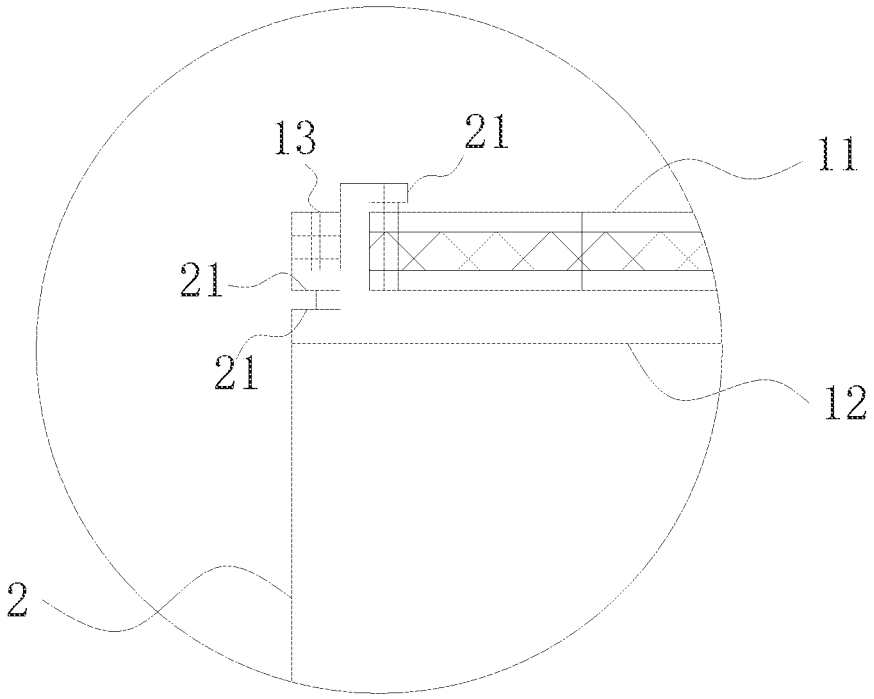
FIG. 3 is a partially enlarged view of a cross section of an inflatable mattress according to one embodiment of the present invention.
Figure 4:
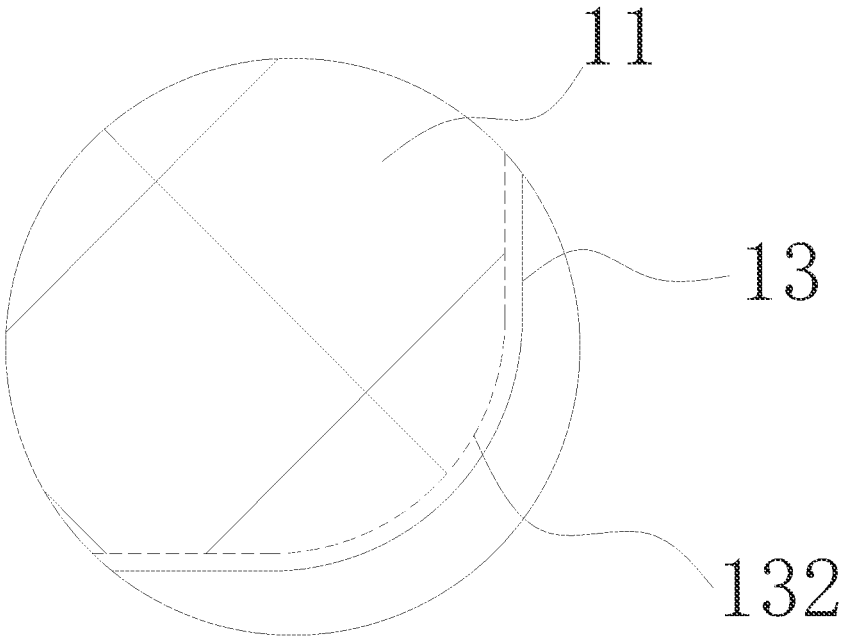
FIG. 4 is a partially enlarged view of a top layer of an inflatable mattress according to one embodiment of the present invention.

As shown in FIG. 3 and FIG. 4, the sealing layer 13 is in form of a zipper, both sides of the zipper and the upper side of the surrounding band are each provided with a bending structure 21, and a bending length of the bending structure 21 is about 0.5 cm. The number of bending layers of the bending structure 21 is designed as one, but not limited to one, which can be designed according to requirements. The bending structure 21 on one side of the zipper is in sewing connection with the bending structure 21 on the upper side of the surrounding band, and the bending structure 21 on the other side of the zipper is in sewing connection with the breathable layer 11. A sewing line 132 is formed at the sewing position. The sewing line 132 surrounds the breathable layer 11 and is lied inside the sealing layer 13. In such easy way, the breathable layer 11 and the surrounding band 2 are joined together.

Figure 5:
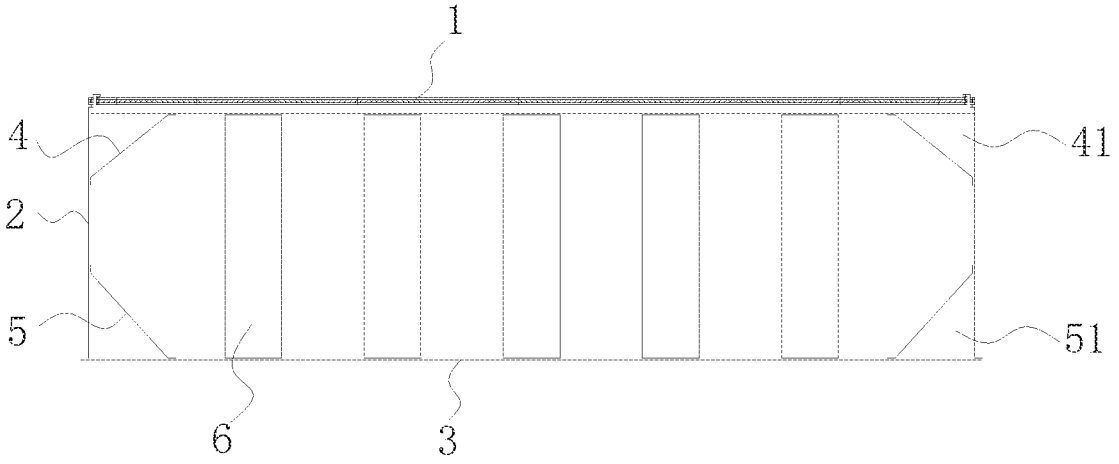
FIG. 5 is a structural schematic diagram of a cross section of an inflatable mattress according to one embodiment of the present invention.

Referring to FIG. 5, according to at least one embodiment, an upper encircling piece 4 and a lower encircling piece 5 can be provided. An upper edge air chamber 41 is defined by the upper encircling piece 4 with the top layer 1, especially the ticking layer 12 of the top layer 1, and the surrounding band 2. A lower edge air chamber 51 is defined by the lower encircling piece 5 with the bottom layer 3 and the surrounding band 2.

Preferably, material of the upper encircling piece 4 and the lower encircling piece 5 is PVC. The two sides of the upper encircling piece 4 are respectively joined with the surrounding band 2 and the ticking layer 12 by welding or bonding, and the two sides of the lower encircling piece 5 are respectively joined with the surrounding band 2 and the bottom layer 3 by welding or bonding.

According to at least one embodiment, a plurality of drawing bands 6 are provided in the cavity 7, each of which is connected to the top layer 1 and the bottom layer 3. Preferably, the drawing band 6 is in form of column, as shown in FIG. 5, and the upper and lower bottom surfaces thereof are respectively connected to the top layer 1 and the bottom layer 3. Optionally, the drawing band 6 may be either vertical or inclined with respect to the bottom layer 3. In a preferred embodiment, the drawing band 6 is gradually inclined outward from the top layer 1 to the bottom layer 3 of the inflatable mattress from the middle to both sides, i.e., the angle formed by the drawing band disposed closer to the middle of the mattress body with respect to the bottom layer 3 more tends to be a right angle. The drawing band 6 is arranged obliquely, so that force bearing points of the top layer 1 and the bottom layer 3 at each drawing band 6 are different, resulting in that the force on the top layer 1 and the bottom layer 3 is more balanced, the bottom surface of the inflatable mattress will hold the ground more stable, thus ensuring stability and flatness of the inflatable mattress.

The traditional flock/PVC or PVC material is replaced with comfortable fabric for the top layer of the inflatable mattress according to the present embodiment, which greatly improves comfort and breathability of the inflatable mattress, avoids noise caused by friction between the user's body and PVC material, thereby improving user' s sleep quality and meets demands of users widely. In addition, according to the present embodiment, the breathable layer of the inflatable mattress is directly connected with the surrounding band, no additional upper encircling piece is provided at the breathable layer, with such configuration, the inflatable mattress is more aesthetically pleasing and usable area of the inflatable mattress is increased at the same time.

Figure 6:
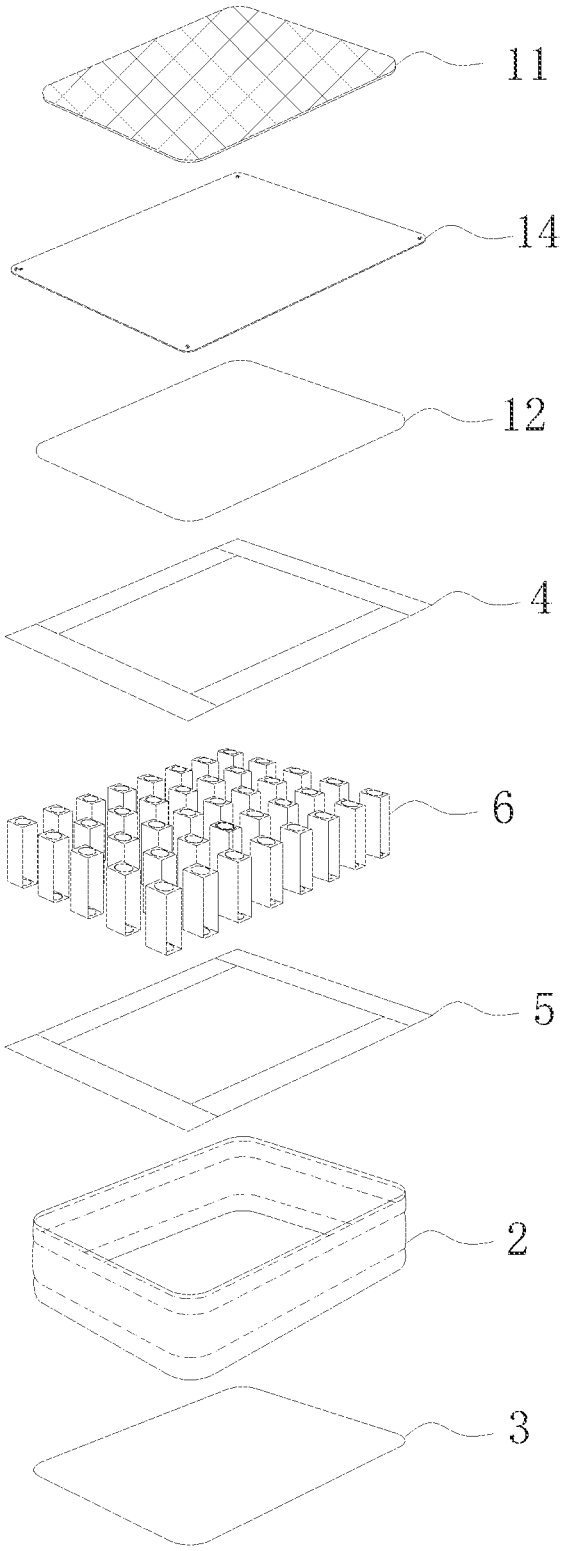
FIG. 6 is an exploded view of an inflatable mattress according to one embodiment of the present invention.
Figure 7:
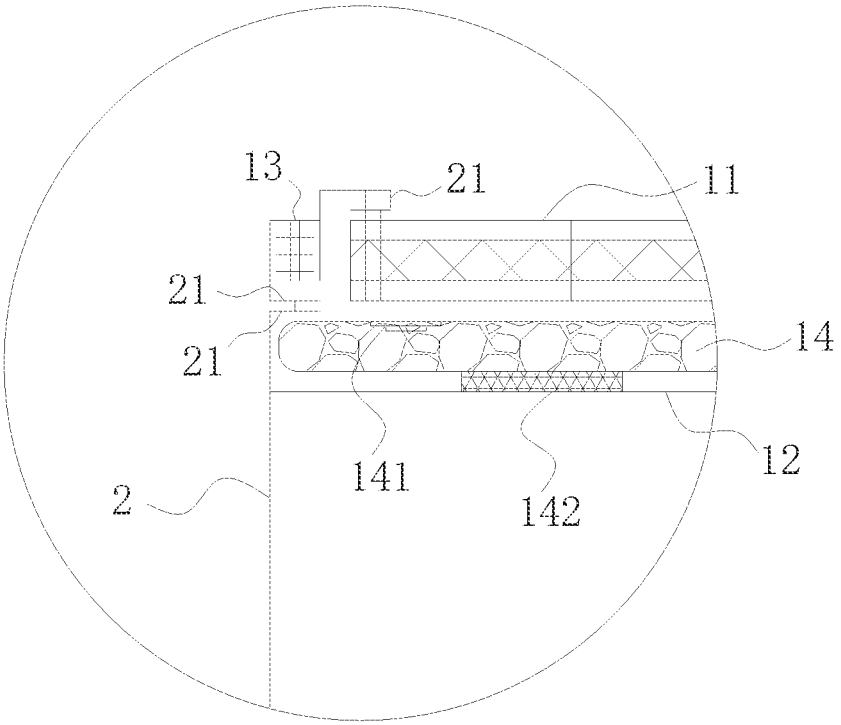
FIG. 7 is a partially enlarged schematic diagram of a cross section of the inflatable mattress in FIG. 6.

According to at least one embodiment, referring to FIG. 6 and FIG. 7, the top layer 1 further includes a soft cushion layer 14. The soft cushion layer 14 is preferably a liquid cushion. In this case, the soft cushion layer 14 is provided with at least one liquid passing port 141, and a plurality of detachable connecting elements 142 are provided below the soft cushion layer 14. Preferably, the detachable connecting element 142 is a snap fastener, in the number of 4, which is respectively provided at four corners of the soft cushion layer. The liquid cushion thus can be fixed to the ticking layer 12 through the snap fastener to avoid displacement thereof Actually, the temperature of the mattress can be adjusted by the temperature of injected liquid to achieve the effect of being warm in the winter and cool in the summer. The snap fastener is convenient to assemble, which has beautiful surface and forms firm connection. What's more, force on the liquid cushion is uniform, and the fluidity of the liquid greatly improves the comfort of the mattress, which can balance the body weight and improve blood circulation of the user. When in use, liquid can be injected into the liquid cushion through the liquid passing port, and when out of use, the liquid is discharged from the liquid passing port, so that the inflatable mattress can be conveniently stored.

With configuration of the soft cushion layer provided on the top layer, which is preferably in form of liquid cushion, not only comfort and softness of the inflatable mattress is improved, but also temperature regulation can be achieved, thereby further improving adaptability of the mattress to meet different demands.

Figure 8:
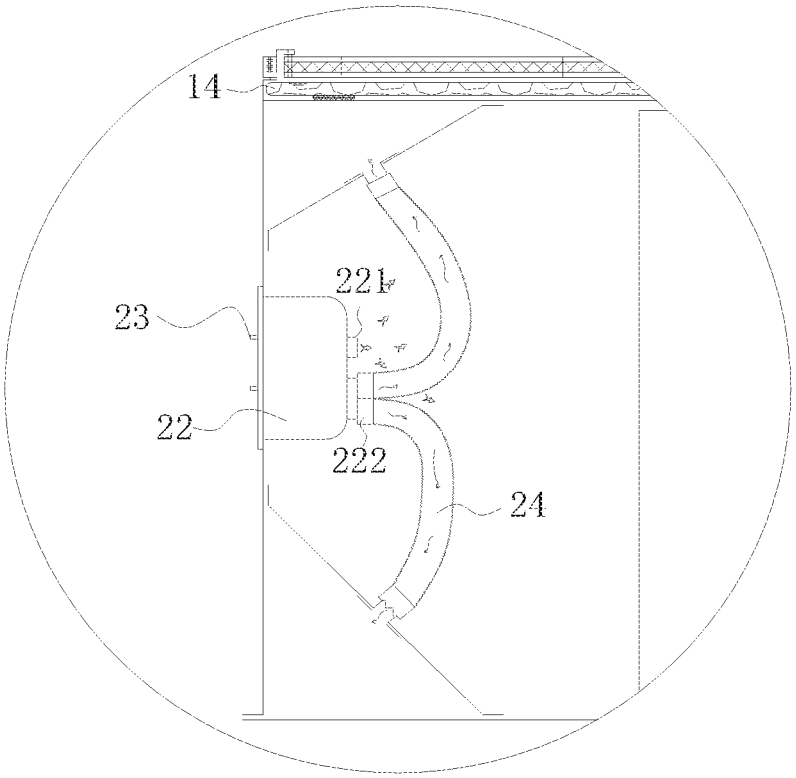
FIG. 8 is a partially enlarged schematic diagram of a cross section of an inflatable mattress according to one embodiment of the present invention.
Figure 16:
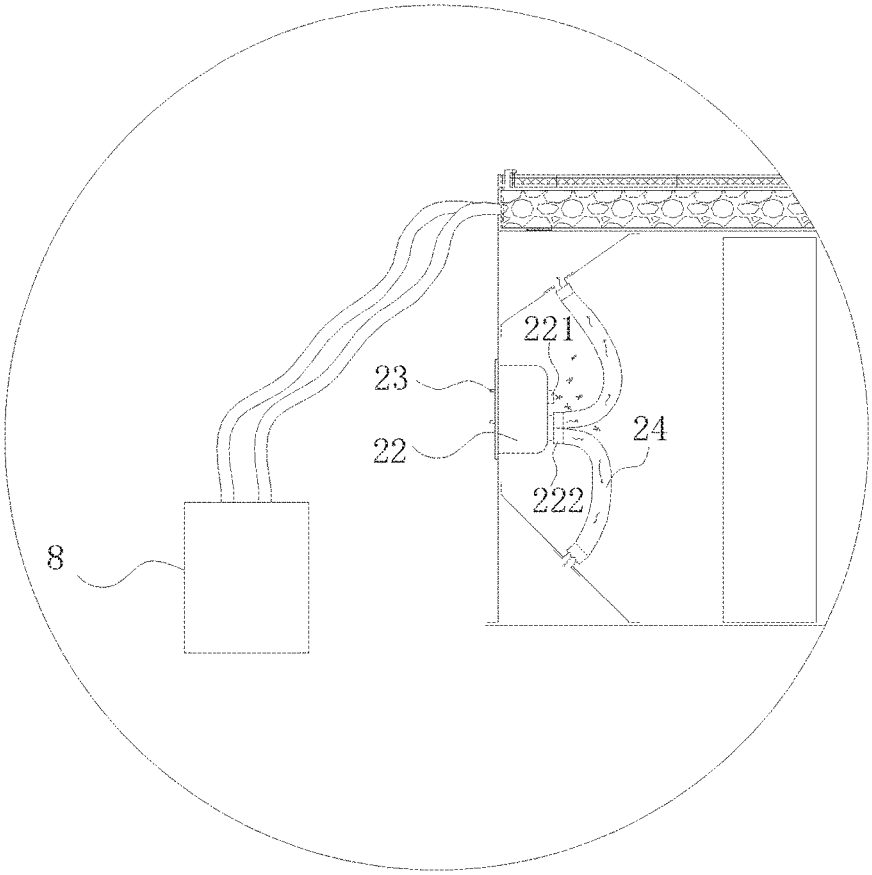
FIG. 16 is a partially enlarged diagram of a cross section of an inflatable mattress according to one embodiment of the present invention.

Referring to FIG. 8 and FIG. 16, a pump 22 can be fixedly on one side of the surrounding band 2 by welding or bonding. A rotary knob 23 is provided on the outer side surface of the pump 22 at the outside of the mattress for controlling opening and closing of the pump 22. A vent 221 and a two-way device 222 are arranged at one side of the pump 22 facing the inner of the cavity 7. Two threaded hoses 24 are connected to the two-way device 222, one threaded hose 24 is communicated with the upper edge air chamber 41, and the other threaded hose 24 is communicated with the lower edge air chamber 51. When the pump 22 is started up, the pump 22 inflates the middle portion of the mattress body through the vent 221, and simultaneously inflates the upper edge air chamber 41 and the lower edge air chamber 51 separately through the threaded hose 24. With such configuration, the shaping and supporting functions of the upper and lower edge air chambers are enhanced.

Figure 9:
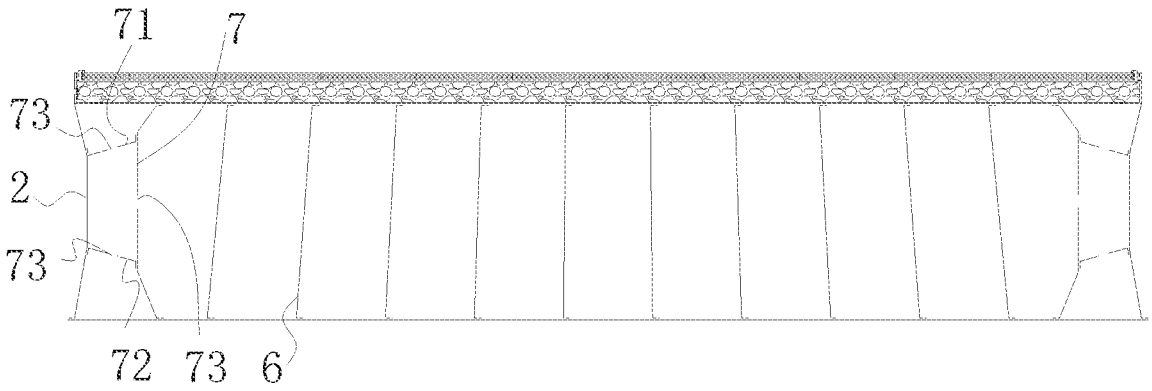
FIG. 9 is a structural schematic diagram of a cross section of an inflatable mattress according to one embodiment of the present invention.
Figure 10:
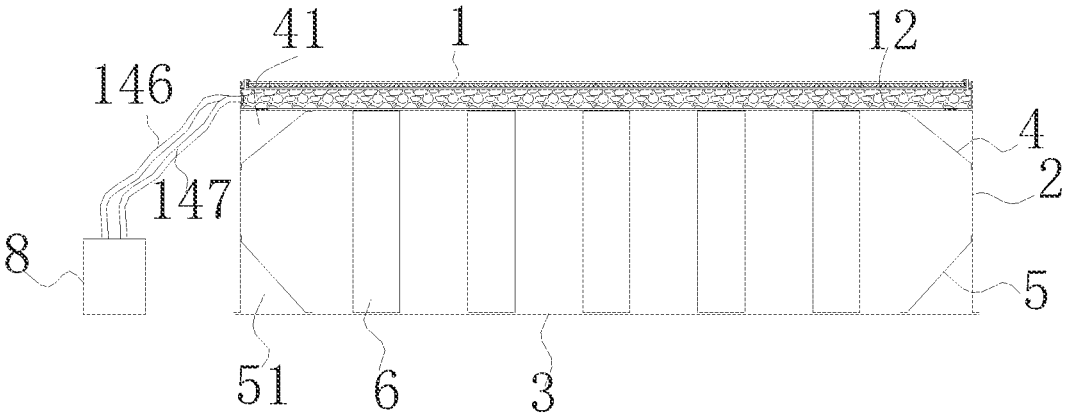
FIG. 10 is a structural schematic diagram of a cross section of an inflatable mattress according to one embodiment of the present invention.
Figure 11:
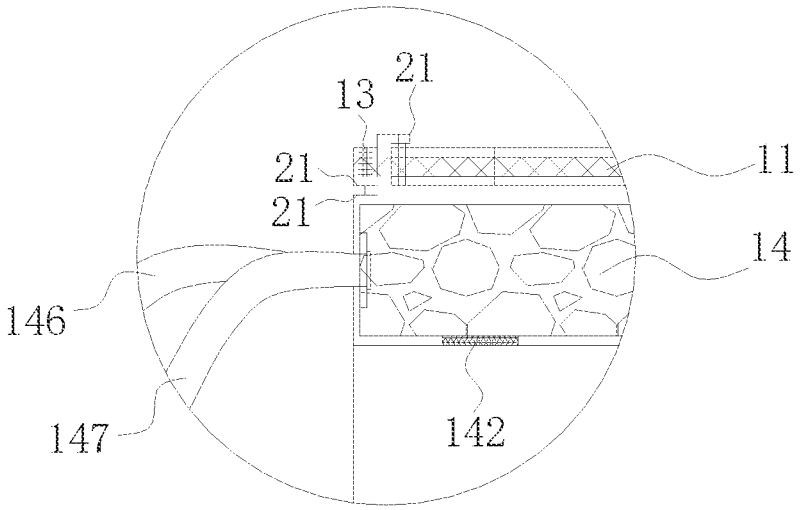
FIG. 11 is a partially enlarged diagram of a cross section of the inflatable mattress shown in FIG. 10.
Figure 12:
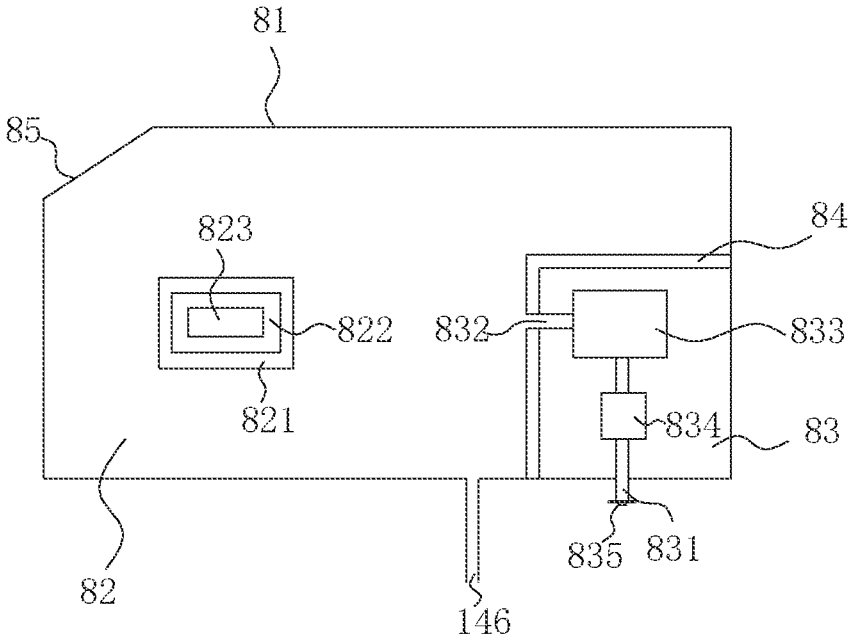
FIG. 12 is a structural schematic diagram of an intelligent cooling/heating system of the inflatable mattress according to one embodiment of the present invention.
Figure 13:
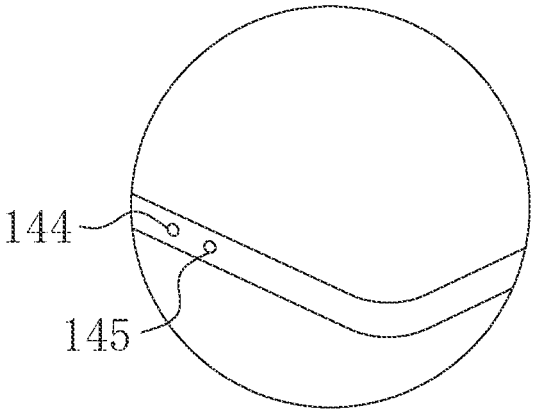
FIG. 13 is a structural schematic diagram showing a liquid inlet and a liquid outlet of a liquid layer of an inflatable mattress according to one embodiment of the present invention.
Figure 17:
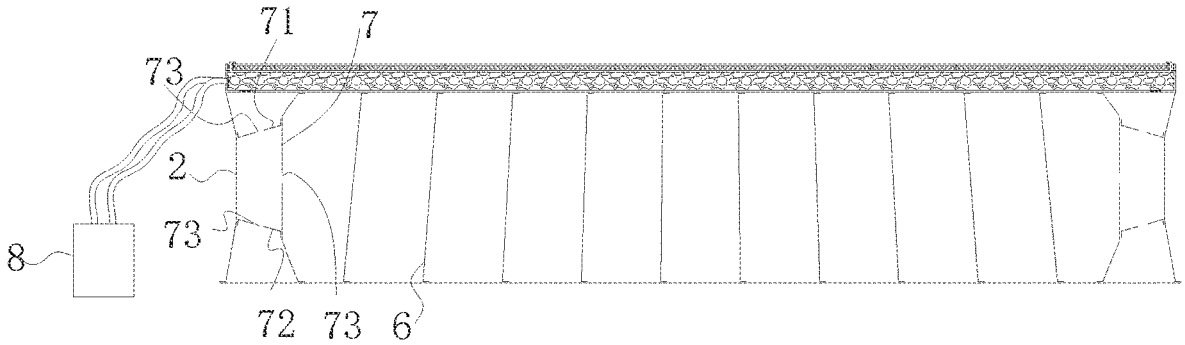
FIG. 17 is a structural schematic diagram of a cross section of an inflatable mattress according to one embodiment of the present invention.

According to at least one embodiment, referring to FIG. 9 and FIG. 17, an inner side wall 7 is arranged inside the mattress body at both sides close to the surrounding band 2. The top layer 1 and the bottom layer 3 are respectively connected to the upper and lower end of the inner side wall 7. An upper side wall drawing band 71 and a lower side wall drawing band 72 are disposed in the mattress body, the upper side wall drawing band 71 and the lower side wall drawing band 72 are connected to the surrounding band and the inner side wall by welding or bonding. The upper edge air chamber 41 is defined by the upper side wall drawing band 71, the surrounding band 2, the inner side wall 7 and the top layer 1, and the lower edge air chamber 51 is defined by the lower side wall drawing band 72, the surrounding band 2, the inner side wall 7 and the bottom layer 3. The upper side wall drawing band 71, the lower side wall drawing band 72 and the inner side wall 7 are each provided with a plurality of air inlets 73.

The drawing band 6 is gradually inclined outward from the top layer 1 to the bottom layer 3 of the inflatable bed from the middle to both sides, i.e., the angle formed by the drawing band 6 arranged closer to the middle of the mattress body with respect to the bottom layer 3 more tends to be a right angle. The drawing band 6 is arranged obliquely, so that force bearing points of the top layer and the bottom layer at the drawing band are different, resulting in that the force on the top layer and the bottom layer is more balanced, the bottom surface of the inflatable mattress will hold the ground more stably, thus ensuring stability and flatness of the inflatable mattress.

According to at least one embodiment, referring to FIG. 10 to FIG. 13, the soft cushion layer 14 is connected to an intelligent cooling/heating system 8 via a liquid inlet pipeline 146 and a liquid outlet pipeline 147. One side of the soft cushion layer 14 is provided with a liquid inlet 144 and a liquid outlet 145, and the liquid outlet 145 is connected to the liquid outlet pipeline 147. The surrounding band 2 is provided with two through holes (not shown for clarity) corresponding to the liquid inlet 144 and liquid outlet 145 respectively, and the liquid inlet pipeline 146 and the liquid outlet pipeline 147 respectively pass through the two through holes.

The intelligent cooling/heating system 8 is used for regulating the temperature of the liquid in the soft cushion layer 14. The system has a housing 81. A control panel 85 is arranged on the top of the housing 81, especially at the left side thereof An L-shaped plate 84 is provided at the bottom of the right side of the housing 81, which divides the housing 81 into a first chamber 82 and a second chamber 83. The first chamber 82 is a liquid chamber. Both sides of the liquid chamber are respectively provided with a cooling end exchanger 821 extending into the liquid chamber, the exteriors of the two cooling end exchangers 821 are respectively provided with a cooling element 822, and the outer sides of the two cooling elements 822 are respectively provided with a heat sink 823. One side of the first chamber 82 is provided with a hole, the liquid outlet pipeline 147 extends into the liquid chamber through the hole. A circulating liquid pump 833 is arranged in the second chamber 83. The circulating liquid pump 833 is connected to an external power supply through a wire, an input end of the circulating liquid pump 833 is fixedly connected to a liquid pumping pipe 832, an output end of the circulating liquid pump 833 is connected to a liquid passing pipeline 831 communicating with the liquid inlet pipeline 146, a PTC heater 834 is provided on the liquid passing pipeline 831, and one side of the housing close to the second chamber is provided with heat dissipation holes (not shown in the figures).

When the inflatable mattress needs to be heated, the PTC heater 834 is started up via the control panel 85, the liquid in the liquid cushion enters the liquid box via the liquid outlet pipeline 147, the circulating liquid pump 833 is started, the liquid in the liquid chamber is pumped to the liquid passing pipeline 831 via the liquid pumping pipe 832, and the liquid heated by the PTC heater 834 enters the liquid cushion via the liquid inlet pipeline 146, the temperature of the inflatable mattress thus rises. Otherwise, when the inflatable mattress needs to be cooled, the cooling element 822 starts to work via the control panel 85 and the PTC heater 834 stops working, the two cooling elements 822 absorb heat from the liquid in the liquid chamber through the cooling end exchangers 821, thereby cooling the liquid in the liquid chamber.

In this case, with configuration of an intelligent temperature regulating system, temperature regulation of the soft cushion layer is realized, which meet the user's temperature requirements for different seasons, thus further improving comfort of the inflatable mattress and optimizing user's experience.

Figure 14:
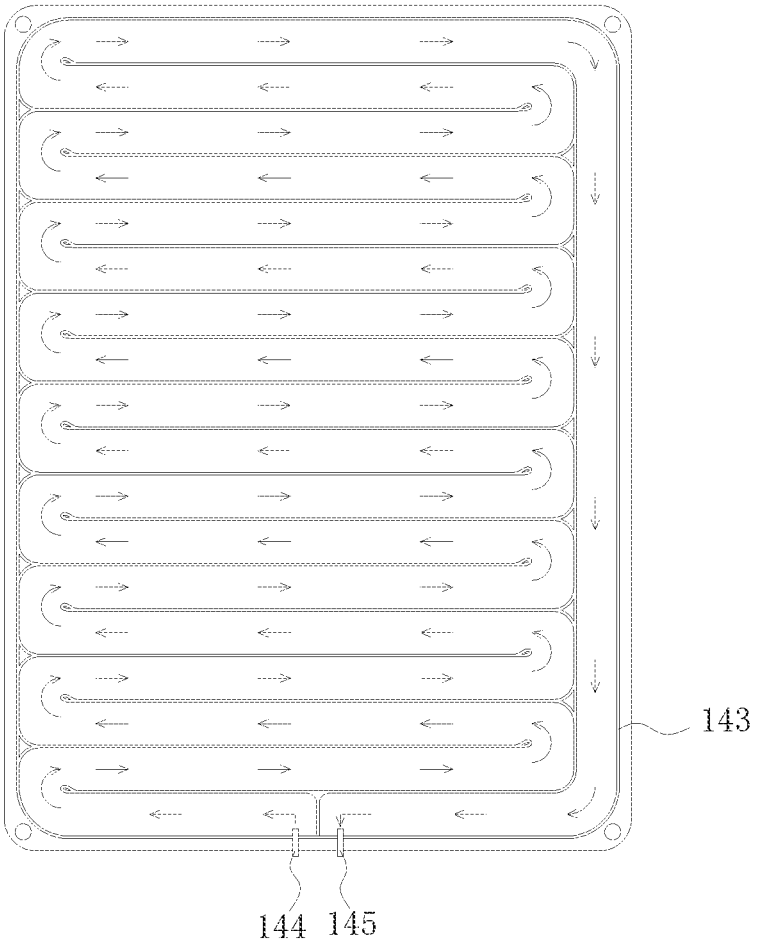
FIG. 14 is a liquid loop circulation diagram of an inflatable mattress according to one embodiment of the present invention.

As shown in FIG. 14, spacers 143 can be further provided in the soft cushion layer 14 to form a liquid loop channel in S-shaped curve. In such configuration, liquid can be heated more evenly, user's experience of the inflatable mattress by regulating temperature thus can be optimized. Preferably, in this case, the liquid circularly flows in horizontal direction, the width of the liquid loop channel is about 10 cm, and the corner of the liquid loop channel is a rounded corner.

Figure 15:
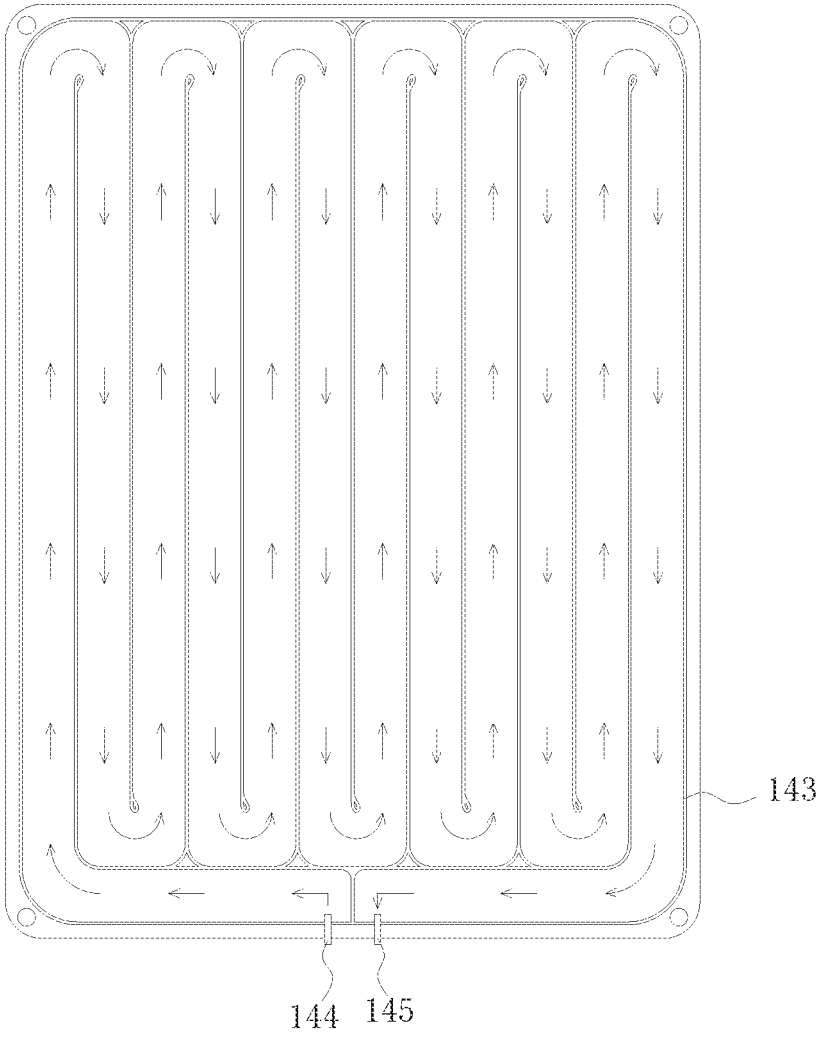
FIG. 15 is another liquid loop circulation diagram of an inflatable mattress according to one embodiment of the present invention.

As shown in FIG. 15, liquid loop channel can also be configured in vertical direction, liquid thus can circularly flow in vertical direction, and the width of the liquid loop channel is about 11.113 cm.

Figure 18:
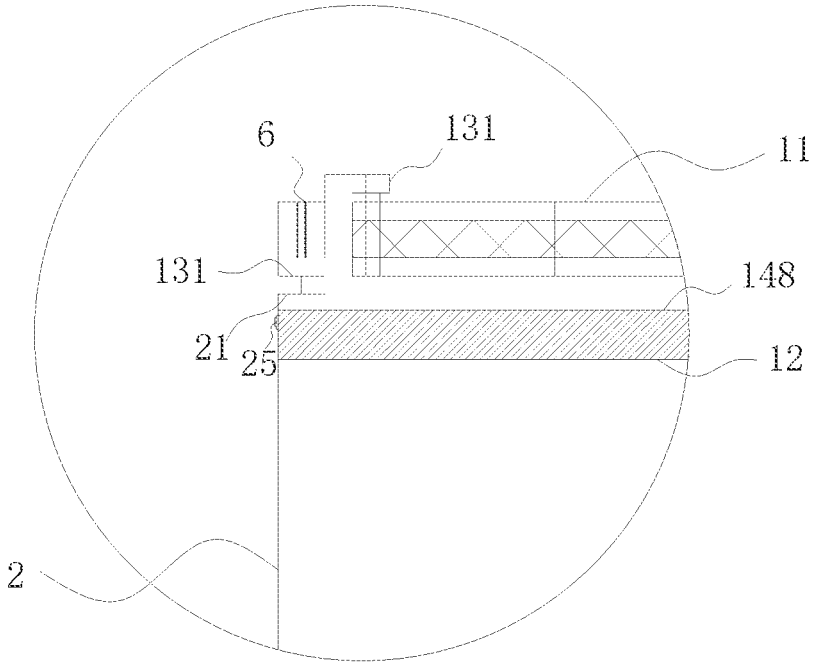
FIG. 18 is a partially enlarged diagram of a cross section of an inflatable mattress according to one embodiment of the present invention.

According to at least one embodiment, referring to FIG. 18, a seal layer 148 is welded on the inner side of the surrounding band 2, and an accommodating cavity formed by the seal layer 148, the ticking layer 12 and the surrounding band 2 is configured to fill liquid. The surrounding band 2 corresponding to the accommodating cavity is provided with an opening 25, so that the liquid in the accommodating cavity can be replaced via the opening 25.

Figure 19:
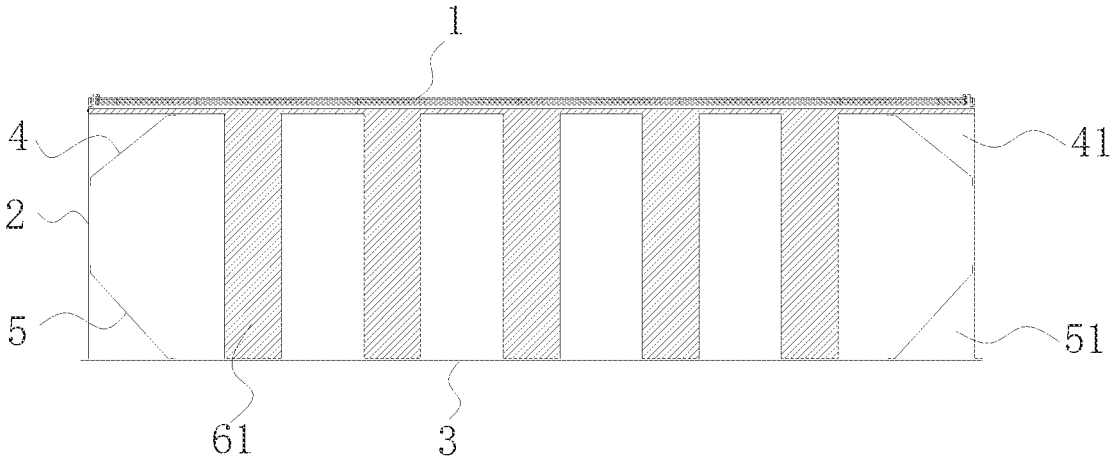
FIG. 19 is a structural schematic diagram of a cross section of an inflatable mattress according to one embodiment of the present invention.

Referring to FIG. 19, a plurality of columnar drawing bands 61 can be further provided between the ticking layer 12 and the bottom layer. The ticking layer 12 is provided with an opening corresponding to the columnar drawing band 61, the bottom end of the columnar drawing band 61 is welded to the bottom layer 3, and the top end of the columnar drawing band 61 is welded to the opening in sealed mode. The accommodating cavity defined by the seal layer 148, the ticking layer 12 and the surrounding band 2 and the hollow columnar drawing band 61 forms a closed communicating space, which space can be filled with liquid.

Figure 20:
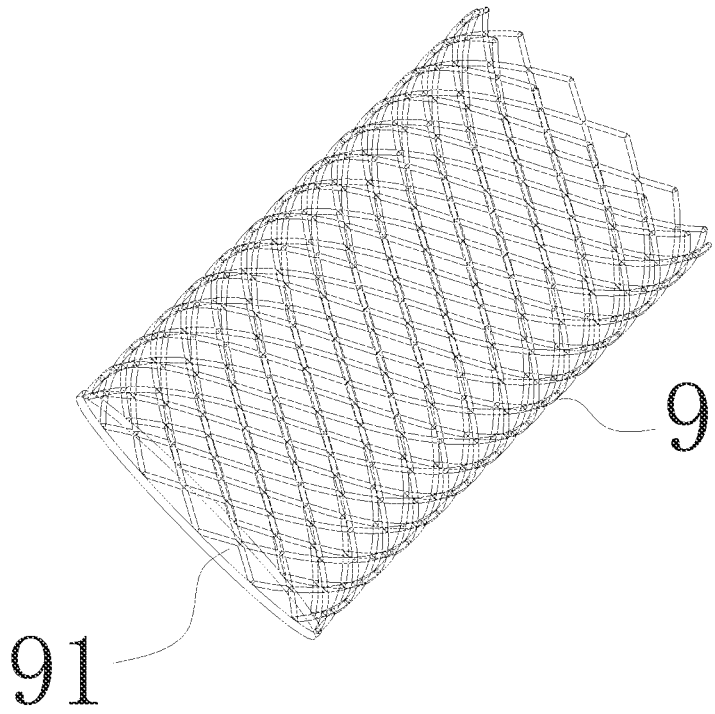
FIG. 20 is a structural schematic diagram showing a metal mesh and a metal sheet according to one embodiment of the present invention.

Referring to FIG. 20, a metal mesh 9 is provide which is closely attached to the inner side of the drawing band and the upper side of the ticking layer 12. A metal sheet 91 connected to the metal mesh 9 is provided in the drawing band, and the metal sheet 91 matches the cross section of a cavity in the drawing band. Material of the metal mesh and the metal sheet can be a carbon fiber composite material.

Figure 21:
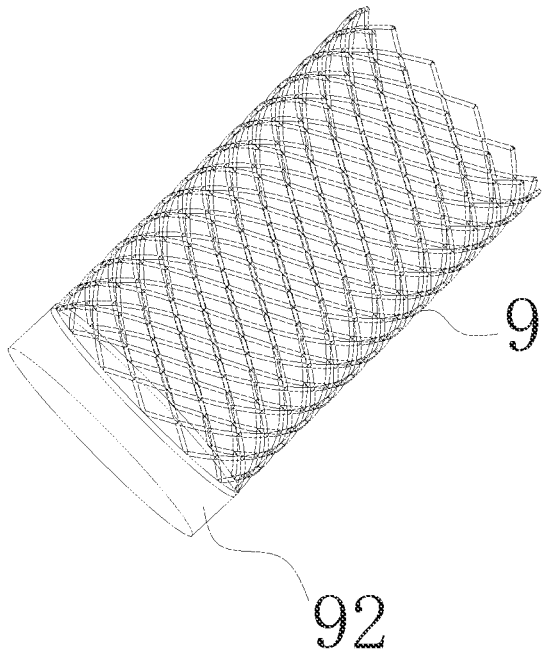
FIG. 21 is a structural schematic diagram showing a metal mesh with a heating disc according to one embodiment of the present invention.
Figure 22:
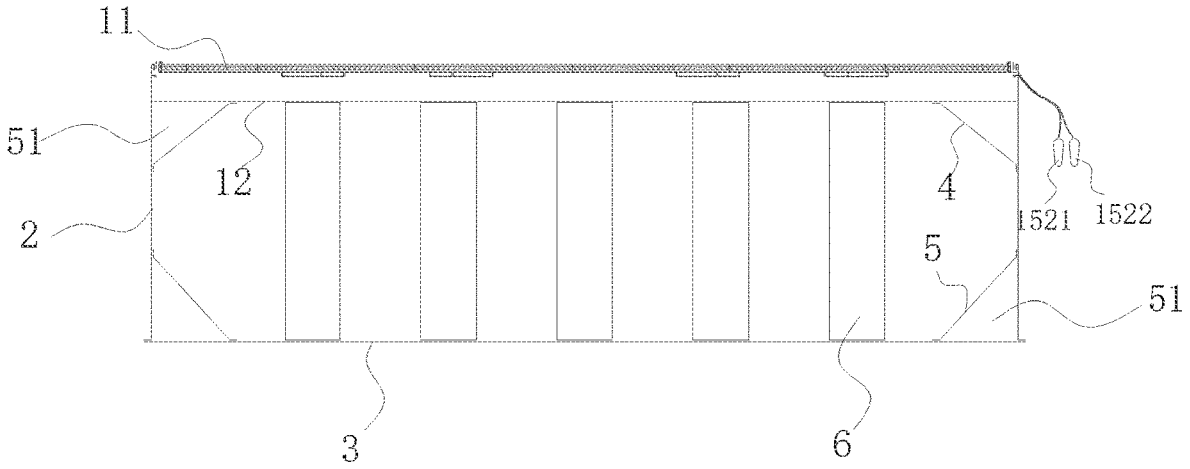
FIG. 22 is a structural schematic diagram of a cross section of an inflatable mattress according to one embodiment of the present invention.
Figure 23:
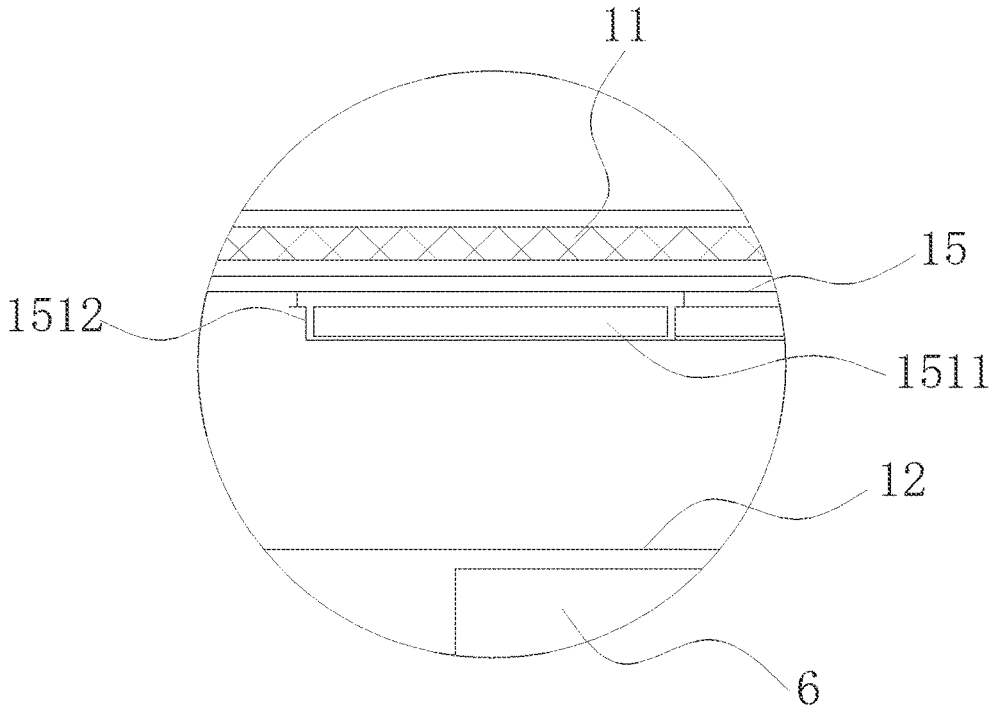
FIG. 23 is a partially enlarged diagram of a cross section of the inflatable mattress shown in FIG. 22.
Figure 24:
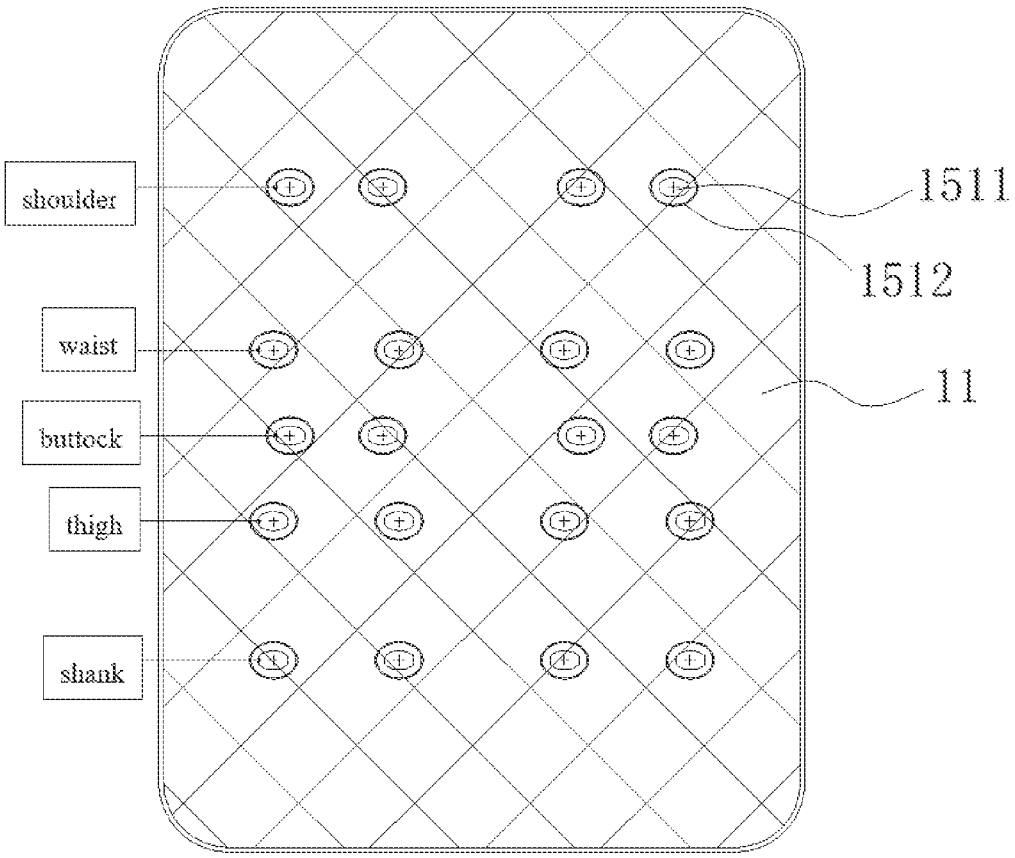
FIG. 24 is a top view of the top layer shown in FIG. 22.
Figure 25:
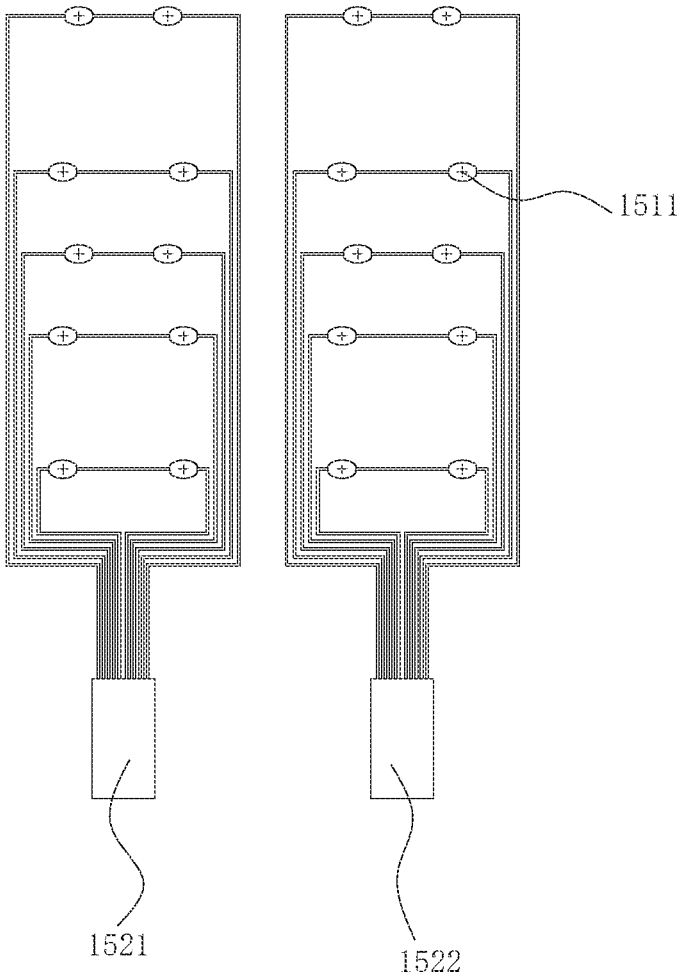
FIG. 25 is a circuit diagram of a control assembly and an eccentric motor according to one embodiment of the present invention.

Referring to FIG. 21, a heating disc 92 can be provided below the metal sheet 91. The heating disc 92 can heat the metal sheet 91, and the metal sheet 91 in turn heats the liquid in the drawing band 61 and the accommodating cavity. The thermal conductivity of the metal mesh is beneficial to accelerate heating of the liquid in the drawing band 61, thus improving the heating efficiency.

Referring to FIG. 22 to FIG. 25, a breathable and comfortable inflatable mattress can be further provided with a massage layer 15. The ticking layer and the surrounding band 2 are joined together. The massage layer 15 is arranged between a breathable layer 11 and the ticking layer, and the breathable layer 11 is joined with the surrounding band 2 by a zipper. Both sides of the zipper and the upper side of the surrounding band 2 are each provided with a bending structure 21. According to the present embodiment, referring back to FIG. 3 and FIG. 4, the bending structure 21 on one side of the zipper is in sewing connection with the bending structure 21 on the upper side of the surrounding band 2, and the bending structure 21 on the other side of the zipper is in sewing connection with the breathable layer 11. A sewing line 132 is formed at the sewing position, which surrounds the breathable layer 11 and is lied inside the zipper. In such easy way, the breathable layer 11 and the surrounding band 2 are joined together. The material of the breathable layer 11 is preferably a pleated cotton cloth.

The massage layer 15 is symmetrically provided with two massage devices 151. Each massage device 151 has at least one massager, which massager is connected to the massage layer 15. Each massager includes an eccentric motor 1511 and a motor fixing cover 1512 connected to the massage layer 15, and the eccentric motor 1511 is disposed in the motor fixing cover 1512. In this embodiment, each massage device 151 has five pairs of eccentric motors 1511 and corresponding motor fixing covers 1512. Accordingly, the two symmetrical massage devices 151 can be configured to jointly massage the shoulders, waist, buttocks, thighs and shanks of the user. Preferably, every pair of the eccentric motors 1511 in each massage device 151 massage the same part.

A control assembly 152 is provided outside the mattress, which is electrically connected to the massage device 151 via an electrical wire, and the electric wire is arranged on the massage layer 15. The electric wire passes through the junction of the head and the tail of the zipper, or the electric wire passing through the breathable layer 11 and the ticking layer.

The control assembly 152 has a dual controller which include a left controller 1521 and a right controller 1522. The left controller 1521 is electrically connected to the eccentric motor 1511 on one side, especially on the left side, and the right controller 1522 is electrically connected to the eccentric motor 1511 on the opposite side, especially on the right side. The eccentric motor 1511 is fixedly connected to the massage layer 15 through the motor fixing cover 1512, and the motor fixing cover 1512 is in sewing connection with the massage layer 15.

The massage layer 15 is in sewing connection with the breathable layer 11, and the massage device 151 is arranged below the massage layer 15.

According to some embodiments, an upper encircling piece 4 can be provided in the mattress, and two ends of the upper encircling piece 4 are respectively joined with the ticking layer and the surrounding band 2 by welding or bonding. A lower encircling piece 5 is arranged in the mattress, and two ends of the lower encircling piece 5 are respectively joined with the ticking layer and the surrounding band 2 by welding or bonding.

Since no transverse drawing band is provided in the mattress, the periphery of the mattress will protrude outward after inflation, the upper encircling piece 4 and the lower encircling piece 5 are provided to limit the shape of the surrounding band 2, which forms a limit for protruding, thereby avoiding collapse of the mattress and also making the mattress more attractive.

In addition, the upper encircling piece 4 and the lower encircling piece 5 are communicated with the interior of the mattress through a plurality of air inlets. The upper edge air chamber and the lower edge air chamber keep intercommunication to form support hardness and deformation resistance, making the mattress in good shaping capacity and ensuring stable support effect when the inflatable mattress is in use, and also making the mattress easy storage and portable. Meanwhile, with configuration of the lower edge air chamber, friction force between the mattress and the ground can be increased, so that the mattress can be hold on the ground more stably, such anti-skid effect further improving comfort of the mattress.

A plurality of drawing bands 6 are arranged in the mattress, each of which is connected to the top layer 1 and the bottom layer 3. The drawing band 6 can be columnar and upper and lower bottom surfaces of the columnar drawing band 6 are respectively connected to the top layer 1 and the bottom layer 3. Optionally, the drawing band 6 is perpendicular with respect to the bottom layer 3. The drawing bands 6 are preferably uniformly distributed in the mattress.

When in use, the switch of the controller is turned on, and all the eccentric motors 1511 start to vibrate to conduct massage. If the switch of the left controller 1521 is turned on, the eccentric motor 1511 located on the left side vibrates to massage the shoulder, waist, buttock, thigh and shank on the left side of the human body. Similarly, if the switch of the right controller 1522 is turned on, the eccentric motor 1511 located on the right side vibrates to massage the shoulder, waist, buttock, thigh and shank on the right side of the human body. It is also possible to turn on both controllers simultaneously for full body massage. In this way, it is possible to satisfy various demands of users, and to greatly and effectively relieve fatigue of the user and improve comfort of the inflatable mattress.

Figure 26:
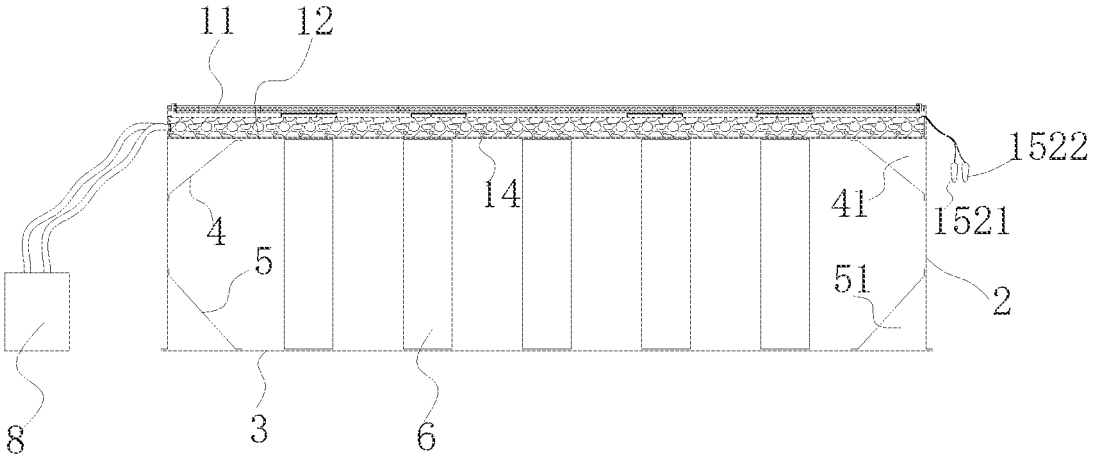
FIG. 26 is another structural schematic diagram of a cross section of an inflatable mattress according to one embodiment of the present invention.
Figure 27:
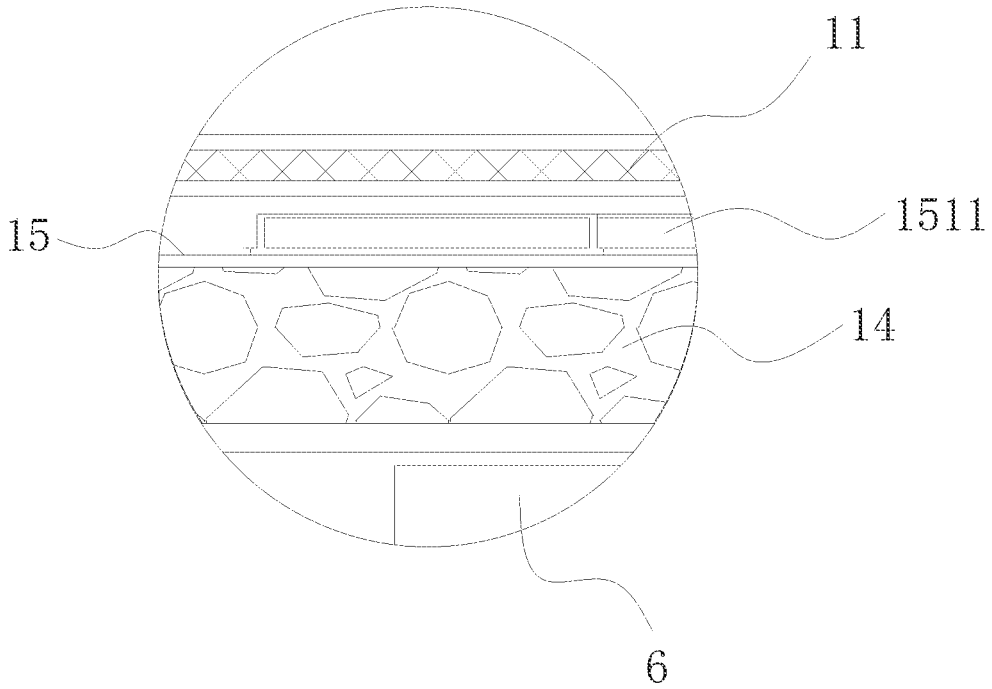
FIG. 27 is a partially enlarged diagram of the cross section of the inflatable mattress shown in FIG. 26.

Referring to FIG. 26 and FIG. 27, a soft cushion layer 14 is further provided between the ticking layer and the massage layer 15. The soft cushion layer 14 is preferably a liquid layer, the massage layer 15 is connected to the liquid layer by a snap fastener, and the massage device 151 is arranged on the massage layer 15.

The soft cushion layer 14 can be connected to an intelligent cooling/heating system 8 via a liquid inlet pipeline and a liquid outlet pipeline according to at least one embodiment. One side of the soft cushion layer 14 is provided with a liquid inlet and a liquid outlet, and the liquid outlet is connected to the liquid outlet pipeline. The surrounding band 2 is provided with two through holes (not shown in the figures) corresponding to the liquid inlet and liquid outlet respectively, and the liquid inlet pipeline and the liquid outlet pipeline respectively pass through the two through holes.

The intelligent cooling/heating system 8 is used for regulating the temperature of the liquid in the soft cushion layer 14. The system has a housing 81. A control panel 85 is arranged on the top of the housing 81, especially at the left side thereof An L-shaped plate 84 is provided at the bottom of the right side of the housing 81, which divides the housing 81 into a first chamber 82 and a second chamber 83. The first chamber 82 is a liquid chamber. Both sides of the liquid chamber are respectively provided with a cooling end exchanger 821 extending into the liquid chamber, the exteriors of the two cooling end exchangers 821 are respectively provided with a cooling element 822, and the outer sides of the two cooling elements 822 are respectively provided with a heat sink 823. One side of the first chamber 82 is provided with a hole, the liquid outlet pipeline extends into the liquid chamber through the hole. A circulating liquid pump 833 is arranged in the second chamber 83. The circulating liquid pump 833 is connected to an external power supply through a wire, an input end of the circulating liquid pump 833 is fixedly connected to a liquid pumping pipe 832, an output end of the circulating liquid pump 833 is connected to a liquid passing pipeline 831 communicating with the liquid inlet pipeline, the liquid inlet pipeline 146 and the liquid passing pipeline 831 are connected via a connecting liquid nozzle 835, a PTC heater 834 is disposed on the liquid passing pipeline 831, and one side of the housing 81 close to the second chamber 83 is provided with heat dissipation holes (not shown in the figures).

When the inflatable mattress needs to be heated, the PTC heater 834 is started up via the control panel 85, the liquid in the liquid cushion enters the liquid box via the liquid outlet pipeline, the circulating liquid pump 833 is started, the liquid in the liquid chamber is pumped to the liquid passing pipeline 831 via the liquid pumping pipe 832, and the liquid heated by the PTC heater 834 enters the liquid cushion via the liquid inlet pipeline, the temperature of the inflatable mattress thus rises. Otherwise, when the inflatable mattress needs to be cooled, the cooling element 822 started to work via the control panel 85 and the PTC heater 834 stops working, the two cooling elements 822 absorb heat from the liquid in the liquid chamber through the cooling end exchangers 821, thereby cooling the liquid in the liquid chamber.

Obviously, the above-mentioned embodiments of the present invention are only examples for clearly illustrating the technical solution of the present invention, rather than limiting the specific implementation modes of the present invention. Any modifications, equivalent replacements and improvements made within the spirit and principles of the claims of the present invention shall be included within the protection scope of the claims of the present invention.

The invention claimed is:

1. A breathable and comfortable inflatable mattress, comprising a top layer, a surrounding band and a bottom layer, a cavity of the inflatable mattress being defined by the top layer, the surrounding band and the bottom layer, wherein the top layer comprises a breathable layer and a ticking layer, the ticking layer and the surrounding band are connected by welding or bonding, the breathable layer is arranged on the ticking layer, and the breathable layer is connected to the surrounding band via a sealing layer;

wherein the top layer further comprises a soft cushion layer, which is arranged between the breathable layer and the ticking layer;

wherein an intelligent cooling/heating system is further provided, which is connected to the soft cushion layer via a liquid inlet pipeline and a liquid outlet pipeline, wherein the intelligent cooling/heating system has a housing, an L-shaped partition plate is provided in the housing, which plate divides the housing into a first chamber and a second chamber, a side face of the first chamber is provided with a cooling end exchanger extending into the housing, a cooling element is provided outside the cooling end exchanger, an opening is formed in a bottom of the first chamber, which opening is communicated with the liquid outlet pipeline; and a circulating liquid pump is provided in the second chamber, a liquid pumping pipe communicating with the first chamber is provided on one side of the circulating liquid pump, a liquid passing pipeline connected to the liquid inlet pipeline is provided on the other side of the circulating liquid pump, and the liquid passing pipeline is connected with a heater.

2. The breathable and comfortable inflatable mattress according to claim 1, wherein the soft cushion layer is in form of a liquid cushion, which is provided with a liquid passing port.

3. The breathable and comfortable inflatable mattress according to claim 1, wherein a plurality of detachable connecting and fixing structures are provided below the soft cushion layer.

4. The breathable and comfortable inflatable mattress according to claim 1, wherein a cooling fin is further provided outside the cooling element, and the liquid inlet pipeline and the liquid passing pipeline are connected via a connecting liquid nozzle.

5. The breathable and comfortable inflatable mattress according to claim 1, wherein a heat dissipation hole is formed in a side of the housing close to the second chamber, a control panel is provided on a top of the housing, which is electrically connected to the cooling element and the heater.

6. The breathable and comfortable inflatable mattress according to claim 1, wherein one side of the soft cushion layer is provided with a liquid inlet connected to the liquid inlet pipeline and a liquid outlet connected to the liquid outlet pipeline.

7. The breathable and comfortable inflatable mattress according to claim 6, wherein the surrounding band is provided with two through holes corresponding to the liquid inlet and liquid outlet, and the liquid inlet pipeline and the liquid outlet pipeline are respectively passed through each through hole.

8. The breathable and comfortable inflatable mattress according to claim 2, wherein spacers are provided in the soft cushion layer to form a liquid loop channel in S-shaped curve.

9. The breathable and comfortable inflatable mattress according to claim 8, wherein the liquid loop channel is in horizontal direction or in vertical direction.

10. The breathable and comfortable inflatable mattress according to claim 1, wherein material of the breathable layer is a single-layer cloth, a multi-layer cloth or a pleated cotton cloth.

11. The breathable and comfortable inflatable mattress according to claim 1, wherein the sealing layer is in form of a zipper, and the zipper is connected to the breathable layer and the surrounding band.

12. The breathable and comfortable inflatable mattress according to claim 11, wherein an upper side of the surrounding band and both sides of the zipper are each provided with a bending structure, and the zipper is respectively connected to the surrounding band and the breathable layer via the bending structure.

13. The breathable and comfortable inflatable mattress according to claim 1, wherein the top layer further comprises a massage layer arranged between the breathable layer and the ticking layer, the breathable layer and the surrounding band are detachably connected, and a massage device including at least one massager is provided on the massage layer, the at least one massager is connected to the massage layer, and a control assembly electrically connected to the massage device is provided outside the inflatable mattress.

14. The breathable and comfortable inflatable mattress according to claim 13, wherein the massage device is divided into a plurality of zones, and the control assembly comprises a plurality of controllers corresponding to the zones.

15. The breathable and comfortable inflatable mattress according to claim 1, wherein an upper encircling piece and a lower encircling piece are provided, an upper edge air chamber is defined by the upper encircling piece, the ticking layer, and the surrounding band, and a lower edge air chamber is defined by the lower encircling piece, the bottom layer, and the surrounding band.

16. The breathable and comfortable inflatable mattress according to claim 1, wherein a plurality of drawing bands in sheet-shaped or columnar shape are uniformly provided in a cavity, each drawing band is connected to the top layer and the bottom layer.

17. The breathable and comfortable inflatable mattress according to claim 1, wherein a seal layer connected to the surrounding band is provided, an accommodating cavity is formed by the seal layer, the surrounding band and the ticking layer, which is configured to fill with liquid.

18. The breathable and comfortable inflatable mattress according to claim 17, wherein a plurality of columnar drawing bands are provided in the accommodating cavity, each columnar drawing band is connected to the top layer and the bottom layer, the ticking layer is correspondingly provided with openings, and the accommodating cavity and the columnar drawing band are forms as a communicating space.

* * * * *